US008696403B2

(12) United States Patent
Haley

(10) Patent No.: US 8,696,403 B2
(45) Date of Patent: Apr. 15, 2014

(54) SURGICAL BRA WITH MASTECTOMY KIT

(71) Applicant: Bras to Help Save the Ta Tas, LLC, Fort Lauderdale, FL (US)

(72) Inventor: Kim P. Haley, Fort Lauderdale, FL (US)

(73) Assignee: Bras To Help Save The Ta Tas, LLC, Fort Lauderdale, FL (US)

( * ) Notice: Subject to any disclaimer, the term of this patent is extended or adjusted under 35 U.S.C. 154(b) by 0 days.

(21) Appl. No.: 13/826,603

(22) Filed: Mar. 14, 2013

(65) Prior Publication Data

US 2013/0252512 A1 Sep. 26, 2013

Related U.S. Application Data

(60) Provisional application No. 61/615,478, filed on Mar. 26, 2012.

(51) Int. Cl.
*A41C 3/00* (2006.01)

(52) U.S. Cl.
CPC ..... *A41C 3/0021* (2013.01); *A41C 3/0028* (2013.01)
USPC ..... 450/36; 450/54; 2/267

(58) Field of Classification Search
USPC ..... 450/36, 54–58; 2/267, 268
See application file for complete search history.

(56) References Cited

U.S. PATENT DOCUMENTS

| | | | | |
|---|---|---|---|---|
| 3,271,748 | A * | 9/1966 | Mazzeo et al. | 365/59 |
| 4,166,471 | A * | 9/1979 | Griffin et al. | 450/54 |
| 4,325,378 | A * | 4/1982 | Wilkinson | 450/77 |
| 4,369,792 | A | 1/1983 | Miller | |
| 4,572,195 | A | 2/1986 | Hyams | |
| 4,804,351 | A | 2/1989 | Raml et al. | |
| 5,257,956 | A * | 11/1993 | Ewen | 450/1 |
| 5,326,305 | A * | 7/1994 | Fochler | 450/57 |
| 5,429,593 | A * | 7/1995 | Matory | 602/79 |
| 5,820,444 | A | 10/1998 | McGaughey | |
| 6,032,289 | A | 3/2000 | Villapiano | |
| 6,168,498 | B1 * | 1/2001 | Wagner | 450/58 |
| 6,390,885 | B1 | 5/2002 | Brooks | |
| 6,464,717 | B1 * | 10/2002 | Smith et al. | 607/108 |
| 7,309,275 | B1 * | 12/2007 | Morales | 450/38 |
| 7,396,272 | B1 * | 7/2008 | Newlen | 450/54 |
| 7,850,508 | B2 | 12/2010 | Pitarelli | |
| 2008/0010717 | A1 | 1/2008 | King | |

OTHER PUBLICATIONS

Web site for Medebra Post-Surgical Solution found at http://web.archive.org/web/20110128142309/http://medebra.com; retrieved from the internet on Feb. 27, 2013.

* cited by examiner

*Primary Examiner* — Gloria Hale
(74) *Attorney, Agent, or Firm* — Smith Gambrell & Russell LLP

(57) ABSTRACT

A surgical compression bra for patient support with a mastectomy kit. The surgical bra includes a body portion with a releasable front closure, shoulder straps with releasable closures, an internal pocket, adjustable poly filled pad prostheses, and a detachable mastectomy pouch.

10 Claims, 4 Drawing Sheets

FIG. 1
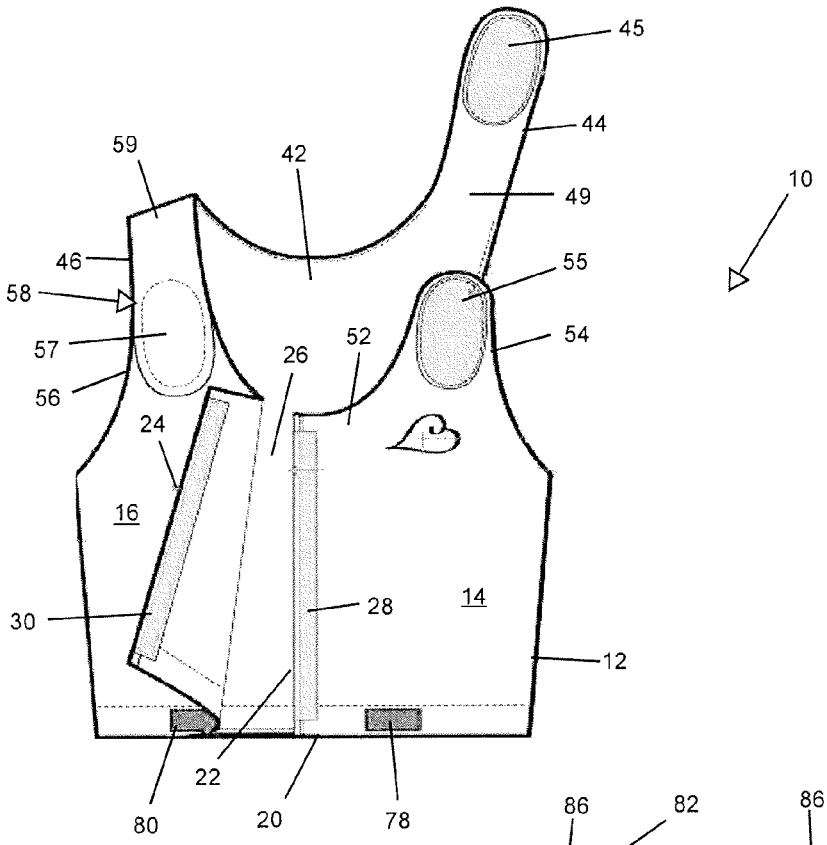
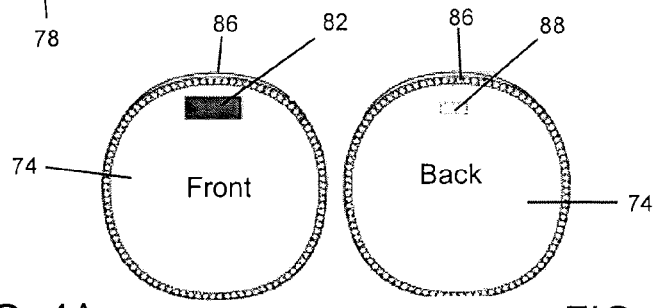
FIG. 4A FIG. 4B

SURGICAL BRA WITH MASTECTOMY KIT

CROSS REFERENCE TO RELATED PATENT APPLICATIONS

This invention claims priority from U.S. Provisional Patent Application Ser. No. 61/615478, filed Mar. 26, 2012, which is hereby incorporated by reference.

FIELD OF THE INVENTION

This invention relates to surgical bras and more particularly a surgical compression bra that is adapted for use after breast surgery, including mastectomy surgery, other surgery, or other procedures to provide support to the patient.

BACKGROUND OF THE INVENTION

After breast surgery, other surgeries, or other procedures, patients often wear surgical compression bras in order to provide support and thereby assist in the healing process and to accommodate the drainage of fluid through drainage tubes inserted in the patient's chest. A surgical bra employed after a mastectomy must accommodate the effects of surgery including the installation of drainage tubes, the presence of port/chest catheter sites, limited movement of the patient's arms, and the accompanying post-operative pain.

SUMMARY OF THE INVENTION

Consequently, there is a need for a surgical bra that is easy to don and doff that is comfortable without irritating seams, that fits snugly, that includes cushioning where incisions have been made, that protects port/chest catheter sites, and that accommodates drainage bags.

The surgical bra of the present invention addresses those needs. The surgical bra of the present invention may also be used for support or comfort for users, who have not undergone surgical procedures such as for support during exercise.

Further objects, features and advantages will become apparent upon consideration of the following detailed description of the invention when taken in conjunction with the drawings and the appended claims.

BRIEF DESCRIPTION OF THE DRAWINGS

FIG. 1 is a front elevation view of a surgical bra with a mastectomy kit in accordance with the present invention.

FIGS. 4A and 4B are front and back plan views respectively of a mastectomy pouch for use in connection with the surgical bra with a mastectomy kit in accordance with the present invention.

DETAILED DESCRIPTION OF THE PREFERRED EMBODIMENT

Figure 2:
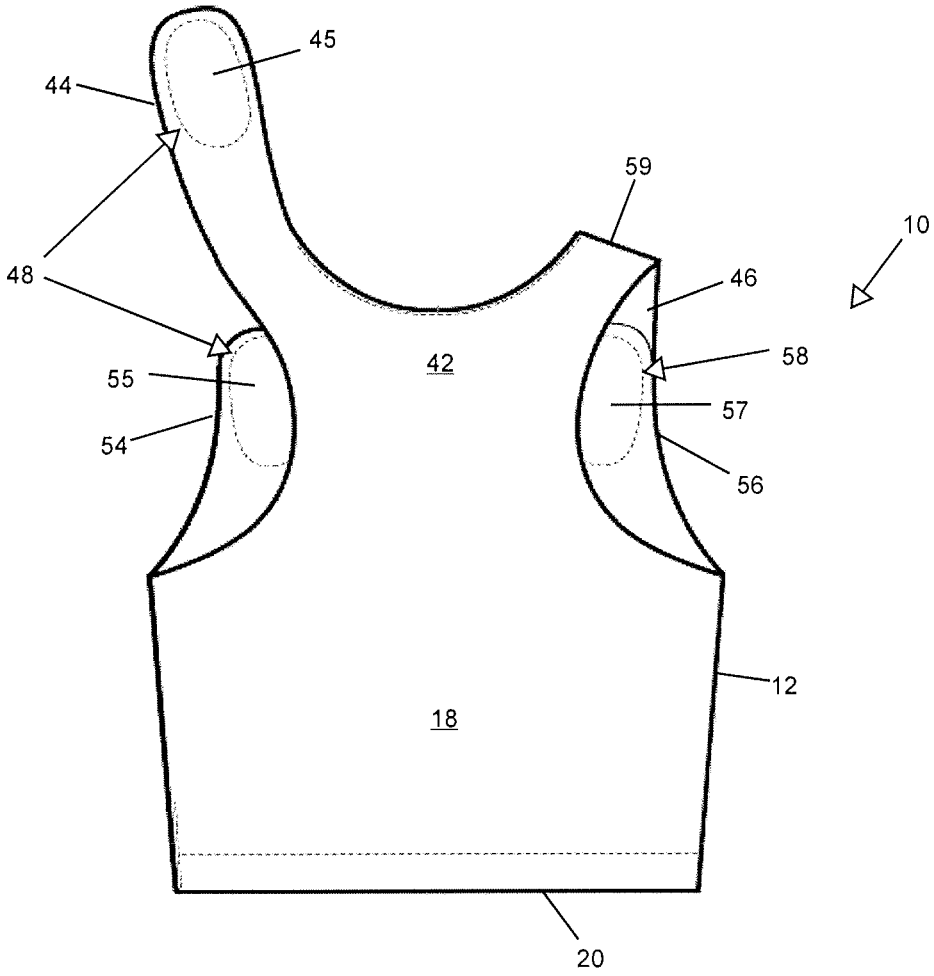
FIG. 2 is a back elevation view of the surgical bra with a mastectomy kit in accordance with the present invention.

Turning to FIGS. 1 and 2, a surgical bra 10, in accordance with the present invention, has a body portion 12 constructed of a single piece of material that wraps around the torso of a patient. The body portion 12 includes a left front panel 14, a right front panel 16, a back panel 18, a back strap section 42 with a left back strap 44 and a right back strap 46, and a front strap section 52 with a left front strap 54 and a right front strap 56. As used herein, the terms "left," "right," "front," and "back" referred to the orientation of the panels with respect to the body of a patient wearing the surgical bra 10. For example, the left front panel 14 is the panel of the body portion 12 of the surgical bra 10 adjacent the patient's left side (heart).

The material of the body portion 12 is a cotton/Lycra blend (approximately 93%-7%) so that the body portion is stretchable. The surgical bra 10 has no latex. The body portion 12 is die cut from the cotton/Lycra blend material, and the die cut edges of the body portion 12 are stitched with a 301 chain stitch in order to create soft edges around the periphery of the body portion 12. The body portion 12 has a lower edge 20 that is elasticized.

The left front panel 14 has a left front panel center edge 22, and the right front panel 16 has a right front panel center edge 24. A hook and loop closure 26 consists of a hook and loop closure strip 28 attached to the left front panel center edge 22 and a hook and loop closure strip 30 attached to the right front center panel edge 24. The hook and loop closure 26 is therefore located adjacent the center of the patient's chest so that the patient can easily open and close the body portion 12 with the hook and loop closure 26 in front.

With continuing reference to FIGS. 1 and 2, the back strap section 42 of the surgical bra 10 extends from the back panel 18 toward the neck of the patient. The back strap section 42 covers a portion of the patient's back between the patient's shoulder blades. The left back strap 44 and the right back strap 46 extend upwardly from the back strap section 42. Consequently, the back strap section 42 provides dimensionally established location points for the back straps 44 and 46. The left back strap 44 has a left hook and loop closure pad 45, and the right back strap 46 has a right hook and loop closure pad 47.

The left front strap 54 extends upwardly from the left front panel 14, and the right front strap 56 extends upwardly from the right front panel 16. The left front strap 54 has a left hook and loop closure pad 55, and the right front strap 56 has a right hook and loop closure pad 47. The left hook and loop closure pad 45 on the left back strap 44 engages the left hook and loop closure pad 55 on the left front strap 54 to form a left strap hook and loop closure 48 and thereby complete a left shoulder strap 49. The right hook and loop closure pad 47 on the right back strap 46 engages the right hook and loop closure pad 57 on the right front strap 56 to form a right strap hook and loop closure 58 and thereby complete a right shoulder strap 59. The dimensions of the hook and loop closure pads 45, 55, 47, and 57 allow for adjustment in the length of the shoulder straps 49 and 59 to accommodate the individual needs of the individual patient, such as the need for the surgical bra 10 to be positioned lower on one patient and higher on another patient.

The shoulder straps 49 and 59 are also dimensioned and located so that the shoulder straps 49 and 59 completely cover the standard port/chest catheter sites. In that regard, the shoulder straps 49 and 50 are of sufficient width to extend across the width of the port/chest catheter sites, and the shoulder straps 49 and 50 are located toward the center of the wearer's chest so that the shoulder straps 49 and 50 extend over the port/chest catheter sites. The shoulder straps 49 and 59 may include additional padding at the sites of a catheter ports. Further, the adjustable straps allow a dialysis patient to secure the ends of a dialysis catheter to the patient's chest thereby assuring that the ends of the dialysis catheter are not accidentally pulled from the patient.

Figure 3:
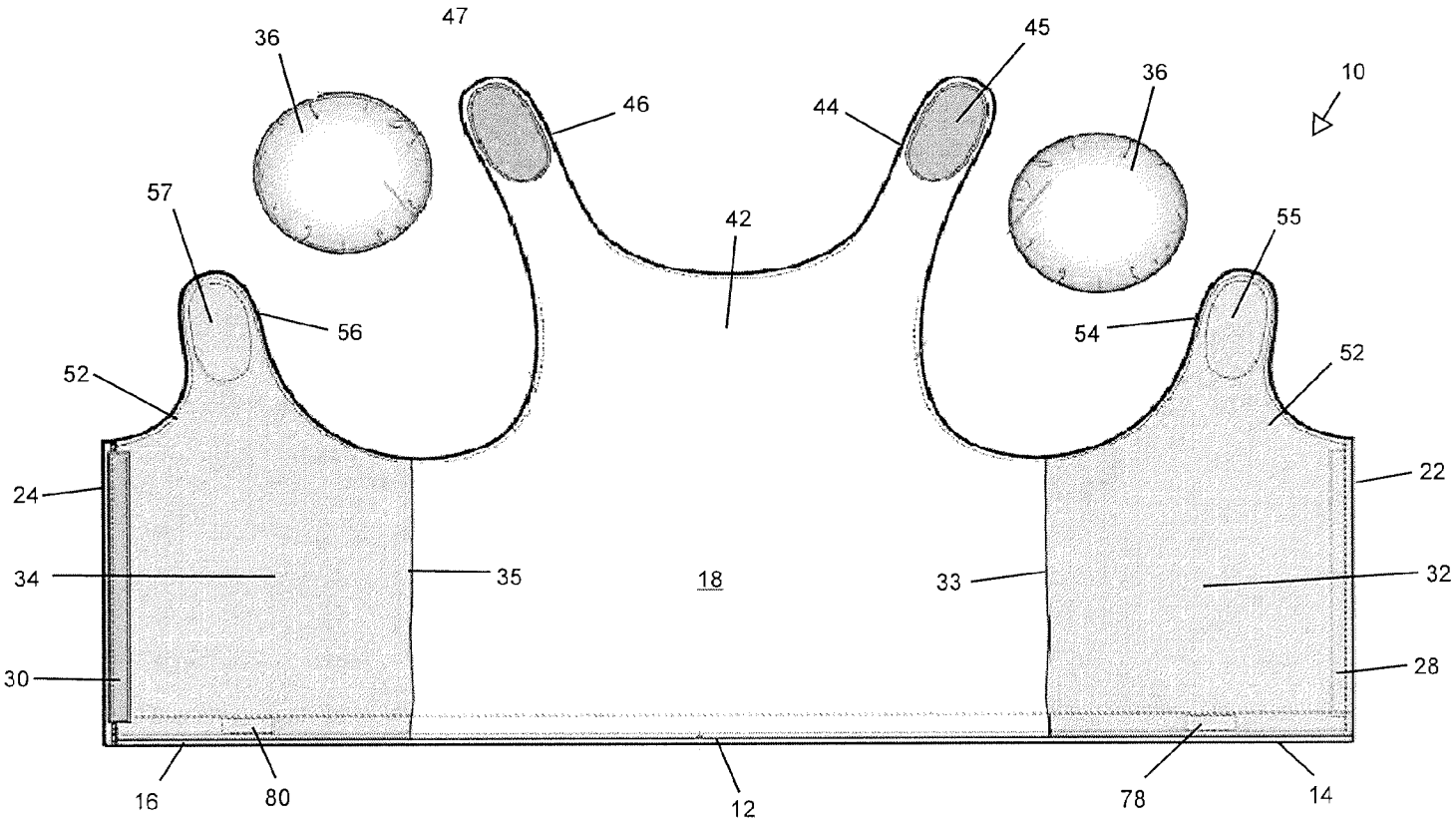
FIG. 3 is an inside elevation view of the surgical bra with a mastectomy kit in accordance with the present invention.

The surgical bra 10, of the present invention, also has additional features, which recommend the surgical bra 10 for use in connection with mastectomy surgery or other breast surgeries. In that regard, and as shown in FIG. 3, a left internal pocket 32 is formed inside of the left front panel 14, and a right internal pocket 34 is formed inside the right front panel 16. The left internal pocket 32 and the right internal pocket 34 are constructed by attaching, typically by sewing, a separate piece of material for each internal pocket 32 or 34 to the body portion 12 along the matching edges of the internal pockets 32 and 34 and the matching edges of the body portion 12. A left pocket opening 33 is created by leaving the edge of the left internal pocket 32 unattached to the body portion 12. A right pocket opening 35 is created by leaving the edge of the right internal pocket 34 unattached to the body portion 12. Adjustable poly filled pads 36 may be inserted into the internal pockets 32 and 34 to provide cushioning and act as prostheses for the patient. The poly filled pads 36 are constructed of two circular pieces of material, such as the cotton/Lycra blend material or other suitable material. The two circular pieces of material are stitched together around their periphery to create a pocket with a soft seam. The pocket is filled with a soft 100% polyester batt. The pads 36 are adjustable to the extent that the amount of fill material can be adjusted to meet the individual needs of the individual patient. Other fill material may be used as would be obvious to a person of ordinary skill in the art. The two pieces of material may be joined at their peripheries by other means such as gluing or heat bonding.

Figure 5:
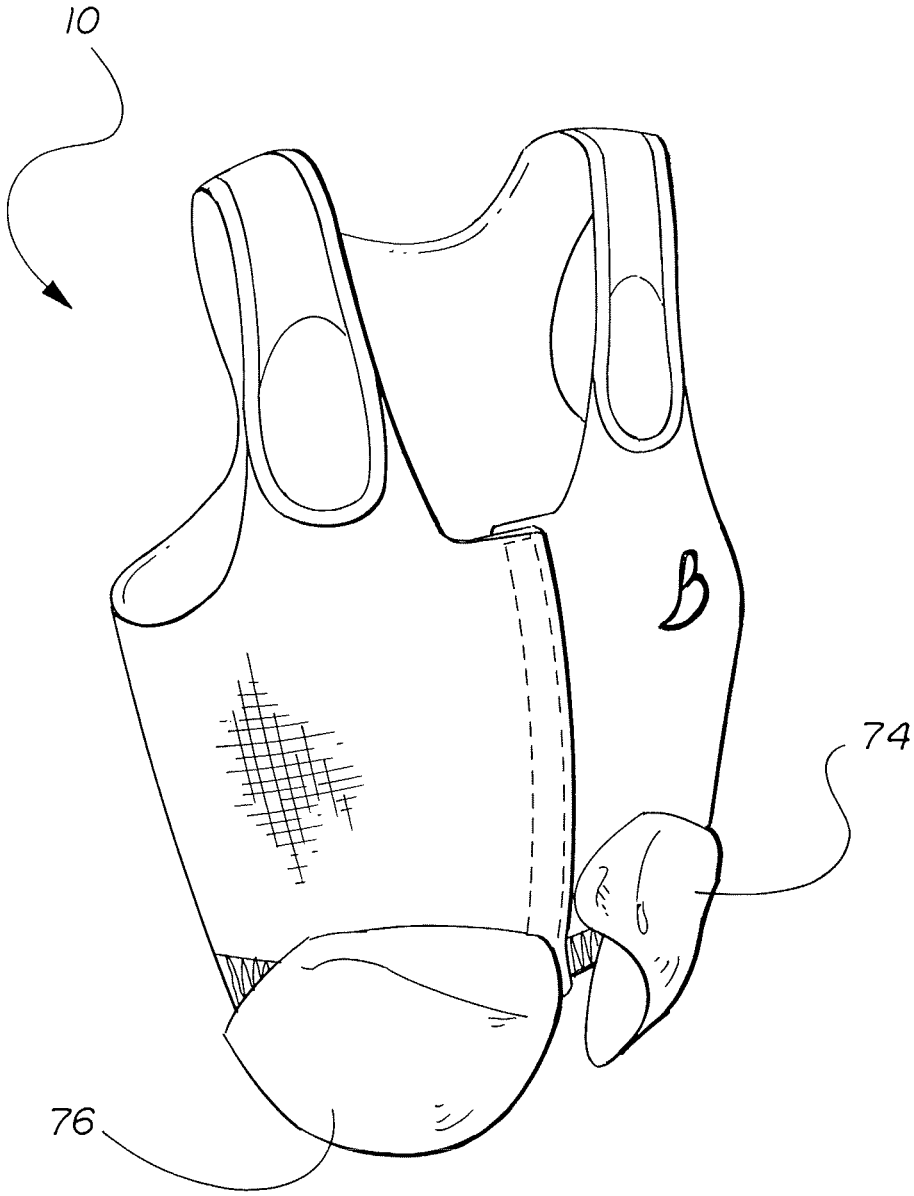
FIG. 5 is a front perspective view of a surgical bra with mastectomy pouches attached thereto in accordance with the present invention.

In addition, the surgical bra 10 has mastectomy pouches 74 and 76 (FIG. 5). The mastectomy pouches 74 and 76 are used to hold bags (bulbs) that are connected to drainage tubes inserted into the chest cavity of the patient. The drainage tubes drain fluid from the patient's chest cavity, and the bags collect the fluid. In order to accommodate the mastectomy pouches 74 and 76, the surgical bra 10 has hook and loop fasteners 78 and 79 attached on the outside of the left panel 14 and on the outside of the right panel 16 and adjacent the lower edge 20. FIGS. 4A and 4B show the back and front of the mastectomy pouch 74. The mastectomy pouch 74 comprises two layers of material (the cotton/Lycra blend material may be used) that are stitched together around their peripheries with opening 86 at the top. The opening 86 may be closed in use by means of a hook and loop fastener 88 inside the mastectomy pouch 74. In addition, the mastectomy pouch 74 has an outside hook and loop fastener 82 that is adapted to engage hook and loop fastener 78 on the surgical bra 10. FIG. 5 shows the mastectomy pouches 74 and 76 connected to the surgical bra 10 by means of the hook and loop fasteners 79 and 78. Once the drainage tubes are removed, the mastectomy pouches 74 and 76 can be filled with a soft poly fiber blend and used as prostheses in addition to poly filled pads 36.

In use after breast surgery, including mastectomy surgery, after other surgeries or other procedures, or in connection with exercise, the patient is able to don the surgical bra 10 by first opening the center closure 26 and opening the strap closures 48 and 58. The surgical bra 10 then can be wrapped around the chest of the patient and secured in place by means of the center closure 26. The stretch characteristics of the material of the body portion 12 and the stretch characteristics of the elastic near the lower edge 20 assure a snug but comfortable fit. The shoulder straps 49 and 59 then can be closed by means of the left strap hook and loop closure 48 and the right strap hook and loop closure 58. Because the hook and loop strap closures 48 and 58 have adjustability, the surgical bra 10 can be properly positioned vertically by adjusting the shoulder straps 49 and 59. Similarly, the surgical bra 10 can be doffed easily by opening the hook and loop strap closures 48 and 58 and the center hook and loop closure 26.

While this invention has been described with reference to preferred embodiments thereof, it is to be understood that variations and modifications can be affected within the spirit and scope of the invention as described herein and as described in the appended claims.

I claim:

1. A surgical bra with mastectomy kit comprising:

a. a body portion that wraps around the torso of a patient, the body portion having:
   i. a back panel:
   ii. a right front panel having a right internal pocket;
   iii. a left front panel having a left internal pocket; and
   iv. a releasable front closure connecting the right front panel to the left front panel;

b. a left shoulder strap, with a releasable left strap closure for connecting the left front panel to the back panel, and a right shoulder strap, with a releasable right strap closure for connecting the left front panel to the back panel; and c. at least one detachable mastectomy pouch releasably connected to the left front panel or the right front panel adjacent the lower edge of the surgical bra.

2. The surgical bra of claim 1, wherein the body portion is a single piece of material that wraps around the torso of the patient, and a single piece of material also forms the shoulder straps.

3. The surgical bra claim 2, wherein the single piece of material is die cut with edge chain stitching to create a soft edge on the single piece of material.

4. The surgical bra of claim 1, wherein the left shoulder strap and the right shoulder strap are of sufficient width and location to cover and pad a catheter port in the patient's torso.

5. The surgical bra of claim 1, wherein the back panel includes a back strap section that extends upwardly and covers a portion of the patient's back between the patient's shoulder blades.

6. A surgical bra with mastectomy kit comprising:

a. a body portion that wraps around the torso of a patient, the body portion having:
   i. a back panel:
   ii. a right front panel having a right internal pocket;
   iii. a left front panel having a left internal pocket; and
   iv. a releasable front closure connecting the right front panel to the left front panel;

b. a left shoulder strap, with a releasable left strap closure for connecting the left front panel to the back panel, and a right shoulder strap, with a releasable right strap closure for connecting the left front panel to the back panel; and c. at least one detachable mastectomy pouch releasably connected to the surgical bra for holding a drainage bag, wherein the mastectomy pouch has an opening with a fastener and is sized so that the mastectomy pouch can accommodate the drainage bag and can be filled with a soft fill material, closed with the fastener, and inserted into the right internal pocket or the left internal pocket to serve as a prosthesis.

7. The surgical bra of claim 6, wherein the body portion is a single piece of material that wraps around the torso of the patient, and a single piece of material also forms the shoulder straps.

8. The surgical bra claim 7, wherein the single piece of material is die cut with edge chain stitching to create a soft edge on the single piece of material.

9. The surgical bra of claim 6, wherein the left shoulder strap and the right shoulder strap are of sufficient width and location to cover and pad a catheter port in the patient's torso.

10. The surgical bra of claim 6, wherein the back panel includes a back strap section that extends upwardly and covers a portion of the patient's back between the patient's shoulder blades.

* * * * *